US008570262B2

(12) United States Patent
Lee et al.

(10) Patent No.: US 8,570,262 B2
(45) Date of Patent: Oct. 29, 2013

(54) LIQUID CRYSTAL DISPLAY WITH BRIGHTNESS-COMPENSATED PIXELS

(75) Inventors: Seung-Kyu Lee, Yongin (KR); Dong-Hoon Lee, Yongin (KR); Chul-Ho Kim, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 283 days.

(21) Appl. No.: 13/069,291

(22) Filed: Mar. 22, 2011

(65) Prior Publication Data

US 2011/0316837 A1 Dec. 29, 2011

(30) Foreign Application Priority Data

Jun. 25, 2010 (KR) ..... 10-2010-0060651

(51) Int. Cl.
*G09G 3/36* (2006.01)

(52) U.S. Cl.
USPC ..... 345/88

(58) Field of Classification Search
USPC ..... 345/88, 92, 214
See application file for complete search history.

(56) References Cited

U.S. PATENT DOCUMENTS

| | | | | |
|---|---|---|---|---|
| 2001/0038369 | A1* | 11/2001 | Adachi et al. | 345/87 |
| 2002/0084970 | A1* | 7/2002 | Ozawa | 345/96 |
| 2004/0085495 | A1* | 5/2004 | Roh et al. | 349/106 |

FOREIGN PATENT DOCUMENTS

| | | | |
|---|---|---|---|
| JP | 2001255851 | A * | 9/2001 |
| JP | 2003-091017 | A | 3/2003 |
| KR | 10-0560795 | B1 | 3/2006 |
| KR | 10-2008-0054549 | A | 6/2008 |
| KR | 10-2008-0086730 | A | 9/2008 |

OTHER PUBLICATIONS

Korean Office Action dated Sep. 27, 2011 for Korean Patent Application No. KR 10-2010-0060651 which corresponds to captioned U.S. Appl. No. 13/069,291.

Korean Office Action dated Jun. 29, 2012 for Korean Patent Application No. KR 10-2010-0060651 which corresponds to captioned U.S. Appl. No. 13/069,291.

* cited by examiner

*Primary Examiner* — Allison Walthall
(74) *Attorney, Agent, or Firm* — Knobbe Martens Olson & Bear LLP

(57) ABSTRACT

A liquid crystal display (LCD) is disclosed. The pixels of the LCD each have storage capacitors, and the capacitances of the storage capacitors of pixels of different colors are different.

9 Claims, 2 Drawing Sheets

LIQUID CRYSTAL DISPLAY WITH BRIGHTNESS-COMPENSATED PIXELS

CROSS-REFERENCE TO RELATED APPLICATIONS

This application claims priority to and the benefit of Korean Patent Application No. 10-2010-0060651, filed on Jun. 25, 2010, in the Korean Intellectual Property Office, the entire content of which is incorporated herein by reference.

BACKGROUND

1. Field

The disclosed technology relates to a liquid crystal display, and more particularly, to a liquid crystal display which compensates for deviation in brightness of red, green, and blue pixels.

2. Description of the Related Technology

A liquid crystal display (LCD) displays an image by controlling the light transmittance of liquid crystals using an electric field. The LCD controls the electric field between a pixel electrode and a common electrode facing each other. An LCD display has a bottom substrate where thin film transistors (TFT) are formed to drive liquid crystals and a top substrate where color filters are formed.

The bottom substrate and the top substrate are attached to each other, and have spacers for uniformly maintaining cell spacing between the bottom substrate and the top substrate, where liquid crystal fills the cell spacing.

The top substrate includes the color filters for realizing color, black matrix for preventing light from leaking, a common electrode for controlling the electric field, and an alignment layer to align the liquid crystal. The bottom substrate includes a plurality of signal wiring lines, TFTs, pixel electrodes coupled to the TFTs, and another alignment layer for aligning the liquid crystal. In addition, the bottom substrate further includes a storage capacitor for stably maintaining the pixel voltage signal charged in the pixel electrode until a next voltage signal is charged.

An LCD display may be driven by various methods. In a vertical switching mode such as a vertical alignment (VA) mode, an electrically controlled birefringence (ECB) mode, and a twisted nematic (TN) mode, color shift is generated in a gray scale region.

In the color shift, because the wavelengths of light that pass through the red, green, and blue color filters are different from each other, the dispersion of the wavelengths are different from each other. Therefore, the transmittances of the wavelengths are different from each other.

In order to address the color shift problem, a liquid crystal panel may be given dispersion characteristics in a white state. In this technique, almost 100% of brightness of the blue pixels is used. However, only about 80% of brightness of green pixels and about 60% of red pixels is used. Therefore, overall, about 20% of brightness is lost.

SUMMARY OF CERTAIN INVENTIVE ASPECTS

One inventive aspect is a liquid crystal display (LCD). The LCD includes a pixel unit with data lines, gate lines, and storage lines. The LCD also includes a plurality of pixels coupled to the data, gate, and storage lines. Each of the pixels includes a thin film transistor (TFT) coupled to one of the gate lines and to one of the data lines, a liquid crystal capacitor coupled to the TFT, the liquid crystal capacitor having a terminal connected to a storage electrode, and a storage capacitor formed by one of the storage lines and the storage electrode overlapping the one storage line. Each pixel is configured to display light of one of a plurality of colors, where the areas of overlapping storage electrodes and storage lines of pixels of different colors are different from each other.

Another inventive aspect is a liquid crystal display (LCD). The LCD includes a plurality of pixels, each configured to selectively transmit light for one of a plurality of colors. Each pixel includes a liquid crystal capacitor, having a terminal connected to a storage electrode, a thin film transistor (TFT) configured to selectively connect a data signal to the storage electrode, a storage line configured to be selectively driven with a boost voltage, and a storage capacitor configured to couple the boost voltage to the liquid crystal capacitor. The storage capacitor is formed by overlapping portions of the storage electrode and the storage line, where the capacitance of the storage capacitors of the pixels of one of the colors is different from the capacitance of the storage capacitors of the pixels of another of the colors.

Another inventive aspect is a liquid crystal display (LCD). The LCD includes a plurality of pixels, each configured to selectively transmit light for one of a plurality of colors, where each pixel includes a liquid crystal capacitor, a thin film transistor (TFT) configured to selectively connect a data signal to the liquid crystal capacitor, and a storage capacitor configured to couple a boost voltage to the liquid crystal capacitor. The capacitance of the storage capacitors of the pixels of one of the colors is different from the capacitance of the storage capacitors of the pixels of another of the colors.

BRIEF DESCRIPTION OF THE DRAWINGS

The accompanying drawings, together with the specification, illustrate exemplary embodiments, and, together with the description, serve to explain the various principles and aspects.

DETAILED DESCRIPTION OF CERTAIN INVENTIVE EMBODIMENTS

Figure 1:
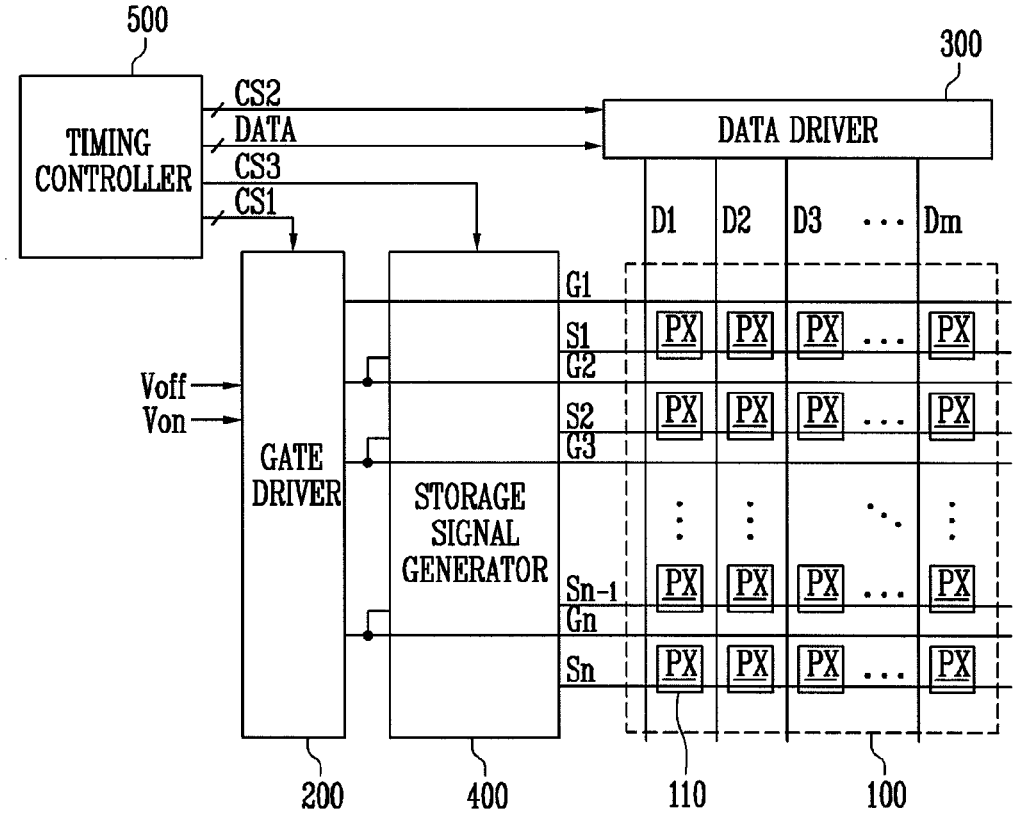
FIG. 1 is a block diagram illustrating a structure of a liquid crystal display (LCD) according to an embodiment.

Hereinafter, certain exemplary embodiments are described with reference to the accompanying drawings. Herein, when a first element is described as being coupled to a second element, the first element may be directly coupled to the second element or may be indirectly coupled to the second element via a third element. Further, some of the elements that are not essential to understanding the invention are omitted for clarity. Also, like reference numerals generally refer to like elements throughout.

Figure 2:
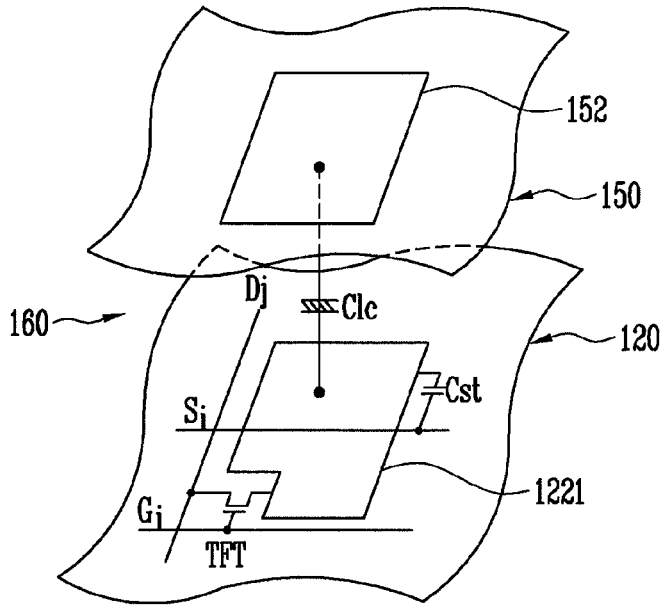
FIG. 2 is a circuit diagram illustrating an embodiment of a pixel used in the LCD of FIG. 1.

Hereinafter, various aspects of certain embodiments are described in detail with reference to the accompanying drawings. FIG. 1 is a block diagram illustrating the structure of a liquid crystal display (LCD) according to an embodiment of the present invention. FIG. 2 is an equivalent circuit diagram illustrating the pixel of FIG. 1.

Referring to FIG. 1, an LCD includes a pixel unit 100 having a plurality of signal lines, that is, data lines D1 to Dm, gate lines G1 to Gn, and storage lines S1 to Sn and a plurality of pixels PX 110, a gate driver 200 for applying gate signals to the gate lines G1 to Gn, a data driver 300 for applying data signals to the data lines D1 to Dm, a storage signal generator 400 for applying storage signals as boost voltages Vboost to the storage lines S1 to Sn, and a timing controller 600 for controlling the gate driver 200, the data driver 300, and the storage signal generator 400.

The timing controller 600 applies control signals CS1, CS2, and CS3 for controlling the gate driver 200, the data driver 300, and the storage signal generator 400 and applies a data signal DATA to the data driver 300.

As shown in FIG. 2, the pixel unit 100 includes first and second substrates 120 and 150 that face each with a liquid crystal layer 160 interposed between the first and second substrates 120 and 150. The data lines D1 to Dm, the gate lines G1 to Gn, and the storage lines S1 to Sn are formed on the first substrate 120.

The gate lines G1 to Gn transmit gate signals. The storage lines S1 to Sn are alternately arranged with the gate lines G1 to G2*n* and transmit the storage signals, or boost voltages Vboost. The data lines D1 to Dm transmit data voltages.

As illustrated in FIG. 2, the gate lines and the storage lines are arranged in a first direction and the data lines are arranged in a second direction. In addition, the plurality of pixels are coupled to the data lines D1 to Dm, the gate lines G1 to Gn, and the storage lines S1 to Sn and are arranged in a matrix.

Referring to FIG. 2, for example, the pixel PX coupled to the ith gate line Gi and the jth data line Dj includes a thin film transistor (TFT) as a switching element Q coupled to the gate line and the data line Gi and Dj, a liquid crystal capacitor Clc coupled to the TFT, and a storage capacitor Cst coupled to the switching element (TFT) and the ith storage line Si.

As illustrated in FIG. 2, the switching element TFT may be realized as a TFT. The gate electrode of the TFT is coupled to the gate line. The source electrode of the TFT is coupled to the data line. The drain electrode of the TFT is coupled to the LCD Clc and the storage capacitor Cst.

The LCD Clc has the pixel electrode 122 of the first substrate 120 and the common electrode 152 of the second substrate 150 as two terminals. The liquid crystal layer 160 between the two electrodes 122 and 152 functions as a dielectric. The pixel electrode 122 is coupled to the switching element TFT. The common electrode 152 is formed on the front surface of the second substrate 150 and receives a common voltage Vcom. The common voltage Vcom may be a direct current (DC) voltage having a uniform magnitude. Unlike that shown in FIG. 2, the common electrode 152 may alternatively be formed on the first substrate 120. At least one of the two electrodes 122 and 152 may be generally linear or rod-shaped.

In addition, the storage capacitor Cst includes first and second electrodes and an insulating layer provided between the first and second electrodes. The first electrode or the second electrode may include the storage line Si or may be electrically coupled to the storage line Si.

The gate driver 200 sequentially applies the gate signals comprising a combination of gate on voltages Von and gate off voltages Voff to the gate lines G1 to Gln. In addition, the storage signal generator 400 is adjacent to the gate driver 200 to receive the gate signals from the gate driver 200 and to apply the storage signals, that is, the boost voltages to the pixels in response to boost control signals corresponding to the gate signals. The boost voltages are applied to the pixels through the storage lines arranged in the pixel unit 100.

Figure 3:
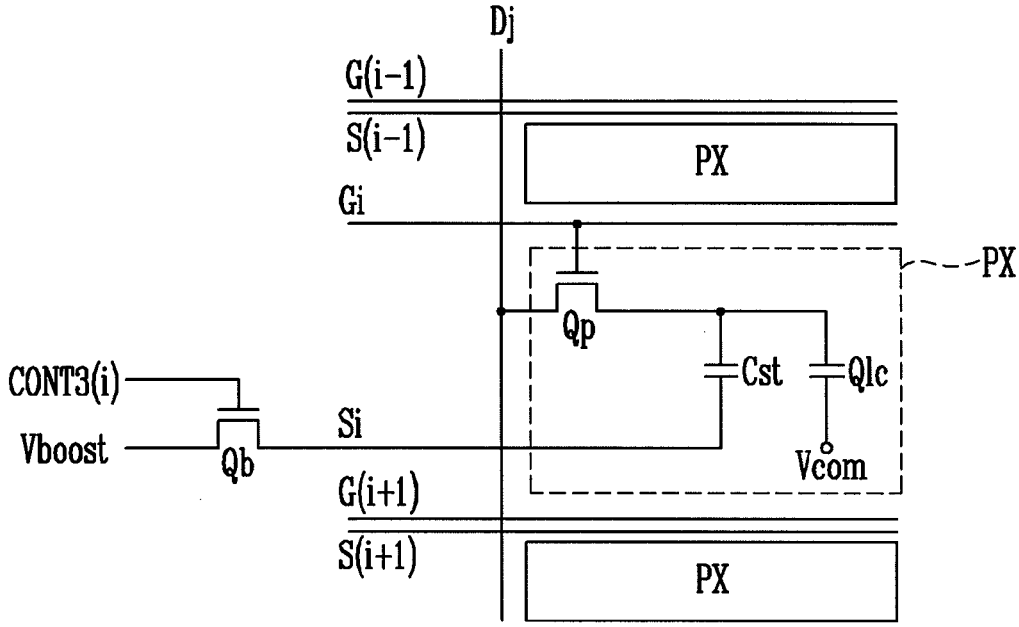
FIG. 3 is a circuit diagram illustrating functionality of the LCD of FIG. 1.

Referring to FIG. 3, (i−1)th to (i+1)th gate lines G(i−1) to G(i+1), (i−1)th to (i+1)th storage lines S(i−1) to S(i+1), and the pixels PX coupled to the above gate lines and storage lines are illustrated. As discussed above, each pixel PX includes a liquid crystal capacitor Clc and a storage capacitor Cst. One terminal of the liquid crystal capacitor Clc is coupled to the pixel switching element TFT and the other terminal is coupled to the common voltage Vcom line. One terminal of the storage capacitor Cst is coupled to the liquid crystal capacitor Clc and the other terminal is coupled to the storage line Si.

In addition, a boost switching element Qb selectively applies the boost voltage Vboost to the storage line Si in response to a boost control signal CONT3(*i*). That is, the storage capacitor Cst receives the boost voltage Vboost in accordance with the on/off states of the boost switching element Qb controlled by the boost control signal CONT3(*i*). In some embodiments, the boost switching element Qb is included in the storage signal generator 400.

In the LCDs illustrated in FIGS. 1 to 3, the pixel voltages in the pixels are determined by the data voltages applied through the data lines and are boosted by the boosting voltages. The amount of the boosting is determined by the relative capacitances of the liquid crystal capacitor Clc and the storage capacitor Cst.

As described above, because the wavelengths of the light that passes through the red, green, and blue pixels are different from each other, the dispersion characteristics of the passed light are different from each other. Therefore, the transmittances of the wavelengths of the different colors are different from each other.

Therefore, if the voltages of the pixels were to be determined without considering the different dispersion characteristics of the red, green, and blue pixels, the brightness of the red, green, and blue pixels would be different from each other.

According to various embodiments, the capacitance of the storage capacitors of the red, green, and blue pixels are different from each other so that the pixel voltages vary according to the dispersion characteristic deviation in the red, green, and blue light pixels. Accordingly, the color shift in the gray scales and the optical loss because of the color shift is avoided and brightness is increased.

Figure 4:
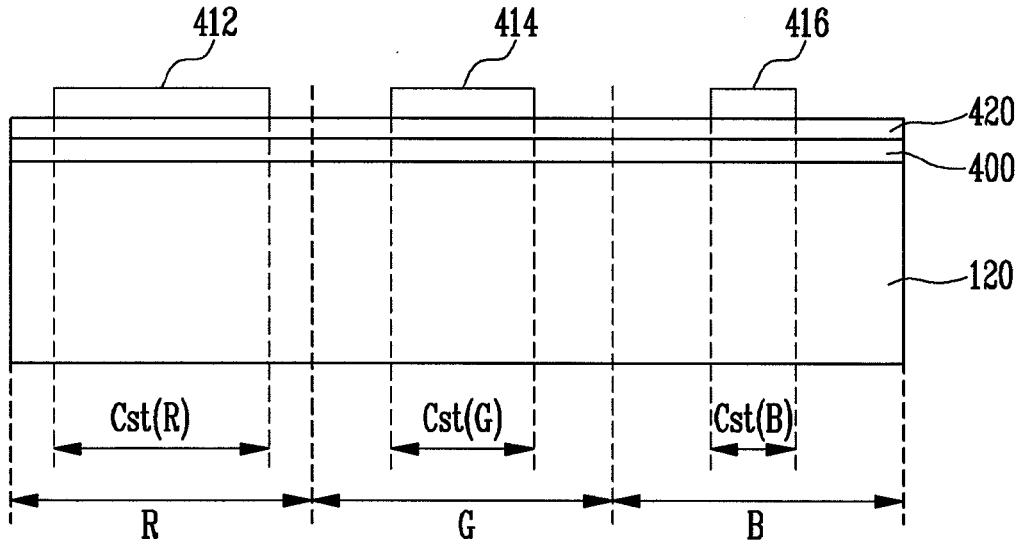
FIG. 4 is a cross-sectional view illustrating the storage capacitor regions of red, green, and blue pixels according to some embodiments.

FIG. 4 is a cross-sectional view illustrating the storage capacitor regions of red, green, and blue pixels according to some embodiments. Referring to FIG. 4, storage capacitors of the pixels Cst(R), Cst(G), and Cst(B) are realized by a storage line 400 formed on a substrate 120 and storage electrodes 412, 414, and 416 formed in the red (R), green (G), and blue (B) pixels that overlap the storage line 400.

The pixels R, G, and B further include TFTs (not shown) electrically coupled to the storage electrodes 412, 414, and 416 of the storage capacitors Cst(R), Cst(G), and Cst(B) and pixel electrodes (not shown) to which the pixel voltages provided through the TFTs are applied.

In the storage capacitors Cst(R), Cst(G), and Cst(B), the storage line 400 functions as a first electrode and the storage electrodes 412, 414, and 416 functions as second electrodes. An insulating layer 420 formed between the storage line 400 and the storage electrodes 412, 414, and 416 functions as the dielectric of the storage capacitors. The capacitances of the storage capacitors Cst(R), Cst(G), and Cst(B) are determined by the area in which the storage line 400 and the storage electrodes 412, 414, and 416 overlap. According to the embodiments, as illustrated in FIG. 4, the areas of the storage electrodes 412, 414, and 416 of the red, green, and blue pixels R, G, and B that overlap the storage line 400 are different from each other. Therefore, the capacitances of the storage capacitors Cst(R), Cst(G), and Cst(B) are different.

In particular, the area of the storage electrode 416 that overlaps the storage line 400 in the blue pixel (B) is smallest of the storage electrodes 412, 414, and 416.

For example, in some embodiments, if the capacitance of the liquid crystal capacitor Clc of each of the pixels is normalized to 1, the area of the storage electrode 416 is arranged so that the capacitance of the storage capacitor Cst(B) of the blue pixel (B) is about 1.67, the area of the storage electrode 414 is arranged so that the capacitance of the storage capacitor Cst(G) of the green pixel (G) is about 3.03, and the area of the storage electrode 412 is arranged so that the capacitance of the storage capacitor Cst(R) of the red pixel (R) is about 4.09.

In the conventional art, the ratio of the capacitance of the liquid crystal capacitor Clc to the capacitance of the storage capacitor Cst is the same (for example 1:3.03) in the red, green, and blue pixels R, G, and B. Therefore, the pixel voltage of each of the pixels generated by applying the boosting voltage to the storage line is the same in the red, green, and blue pixels. That is, in the conventional art, the different light transmittances of the red, green, and blue pixels is not considered.

An optical design of a liquid crystal panel configured to have a white dispersion characteristic was suggested in order to solve the color shift problem. In the suggested design, almost 100% of brightness of the blue pixels is used. However, only about 80% of the brightness of the green pixels and only about 60% of the brightness of the red pixels is used. Accordingly, about 20% of the brightness is lost.

According to various embodiments, the areas of the storage electrodes 412, 414, and 416 of the red, green, and blue pixels R, G, and B that overlap the storage line 400 are different from each other to form the storage capacitors Cst(R), Cst(G), and Cst(B) having different capacitances. For example, if the areas of the storage electrodes 412, 414, and 416 of the pixels are sized so that the ratios of the capacitance of the liquid crystal capacitor Clc to the capacitance of the storage capacitor Cst are 1:4.09, 1:3.03, and 1:1.67 in the red, green, and blue pixels R, G, and B, respectively, the pixel voltages of the red, green, and blue pixels generated by applying the boosting voltages to the storage line 400 are different from each other. That is, since the storage capacitance of the blue pixel B is the least, the boosted voltage of the blue pixel B the least. Since the storage capacitance of the red pixel (R) is the greatest, the boosted voltage of the red pixel R is the greatest. Therefore, the final pixel voltage applied to the red pixel R is greater than the final pixel voltage applied to the blue pixel B despite the boost voltage Vboost being the same.

Therefore, the above-described disadvantage that only about 60% of brightness of the red pixel (R) is used, may be overcome.

As described above, according to various embodiments, because the pixel voltages are boosted in accordance with the capacitances of the storage capacitors Cst(R), Cst(G), and Cst(B) of the red, green, and blue pixels, different voltages are automatically generated in the red, green, and blue pixels so that the brightness loss in the red and green pixels may be eliminated.

While various features and aspects have been described in connection with certain exemplary embodiments, it is to be understood that the invention is not limited to the disclosed embodiments, but, on the contrary, is intended to cover various modifications and equivalent arrangements.

What is claimed is:

1. A liquid crystal display (LCD), comprising:

a pixel unit including data lines, gate lines, and storage lines; and a plurality of pixels coupled to the data lines, gate lines and storage lines, wherein each of the pixels comprises:

a thin film transistor (TFT) coupled to one of the gate lines and to one of the data lines, a liquid crystal capacitor coupled to the TFT, the liquid crystal capacitor having a terminal connected to a storage electrode, and a storage capacitor formed by one of the storage lines and the storage electrode overlapping the one storage line, wherein each pixel is configured to display light of one of a plurality of colors, wherein the areas of overlapping storage electrodes and storage lines of pixels of different colors are different from each other, wherein the colors are red, green, and blue, and wherein, in the blue pixels, the ratio of the capacitance of the storage capacitor to the capacitance of the liquid crystal capacitor is 1.67, wherein, in the green pixels, the ratio of the capacitance of the storage capacitor to the capacitance of the liquid crystal capacitor is 3.03, and wherein, in the red pixels, the ratio of the capacitance of the storage capacitor to the capacitance of the liquid crystal capacitor is 4.09.

2. The LCD as claimed in claim 1, wherein the area of the storage electrode overlapping the storage line of the blue pixel is less than the corresponding areas of the red and green pixels.

3. The LCD as claimed in claim 1, wherein the storage lines are connected to a storage signal generator configured to apply storage signals as boost voltages.

4. The LCD as claimed in claim 1, wherein the storage lines are alternately arranged with the gate lines.

5. The LCD as claimed in claim 1, wherein the gate lines and the storage lines are arranged in a first direction, and the data lines are arranged in a second direction.

6. A liquid crystal display (LCD), comprising:

a plurality of pixels, each pixel configured to selectively transmit light for one of a plurality of colors, and each pixel comprises:

a liquid crystal capacitor having a terminal connected to a storage electrode, a thin film transistor (TFT) configured to selectively connect a data signal to the storage electrode, and a storage line configured to be selectively driven with a boost voltage, wherein the storage electrode overlaps the storage line at selected portions so as to form a storage capacitor configured to feed the boost voltage to the liquid crystal capacitor, wherein the capacitance of the storage capacitors of the pixels of one of the colors is different from the capacitance of the storage capacitors of the pixels of another of the colors, wherein the colors are red, green, and blue and, wherein, in the blue pixels, the ratio of the capacitance of the storage capacitor to the capacitance of the liquid crystal capacitor is 1.67, wherein, in the green pixels, the ratio of the capacitance of the storage capacitor to the capacitance of the liquid crystal capacitor is 3.03, and wherein, in the red pixels, the ratio of the capacitance of the storage capacitor to the capacitance of the liquid crystal capacitor is 4.09.

7. The LCD as claimed in claim 6, wherein the capacitance of the storage capacitors of the blue pixels is less than the capacitance of the storage capacitors of the green and red pixels.

8. A liquid crystal display (LCD), comprising:

a plurality of pixels, each pixel configured to selectively transmit light for one of a plurality of colors, and each pixel comprises:

a liquid crystal capacitor, a thin film transistor (TFT) configured to selectively connect a data signal to the liquid crystal capacitor, and a storage capacitor configured to feed a boost voltage to the liquid crystal capacitor, wherein the capacitance of the storage capacitors of the pixels of one of the colors is different from the capacitance of the storage capacitors of the pixels of another of the colors, wherein the colors are red, green, and blue and, in the blue pixels, the ratio of the capacitance of the storage capacitor to the capacitance of the liquid crystal capacitor is 1.67, wherein, in the green pixels, the ratio of the capacitance of the storage capacitor to the capacitance of the liquid crystal capacitor is 3.03, and wherein, in the red pixels, the ratio of the capacitance of the storage capacitor to the capacitance of the liquid crystal capacitor is 4.09.

9. The LCD as claimed in claim 8, wherein the capacitance of the storage capacitors of the blue pixels is less than the capacitance of the storage capacitors of the green and red pixels.

* * * * *